US006684638B2

(12) United States Patent
Quenzer et al.

(10) Patent No.: US 6,684,638 B2
(45) Date of Patent: Feb. 3, 2004

(54) MICROACTUATOR ARRANGEMENT

(75) Inventors: Hans Joachim Quenzer, Itzehoe (DE); Bernd Wagner, Looft (DE)

(73) Assignee: Fraunhofer Gesellschaft zur angewandten Forderung der Forschung e.V., Munich (DE)

( * ) Notice: Subject to any disclaimer, the term of this patent is extended or adjusted under 35 U.S.C. 154(b) by 0 days.

(21) Appl. No.: 10/239,989

(22) PCT Filed: Mar. 16, 2001

(86) PCT No.: PCT/DE01/01040

§ 371 (c)(1),
(2), (4) Date: Sep. 27, 2002

(87) PCT Pub. No.: WO01/73805

PCT Pub. Date: Oct. 4, 2001

(65) Prior Publication Data

US 2003/0051473 A1 Mar. 20, 2003

(30) Foreign Application Priority Data

Mar. 29, 2000 (DE) ..... 100 15 598

(51) Int. Cl.[7] ..... F01B 29/10
(52) U.S. Cl. ..... 60/527; 60/528
(58) Field of Search ..... 60/527, 528, 529

(56) References Cited

U.S. PATENT DOCUMENTS 4,511,974 A * 4/1985 Nakane et al. ..... 701/124
5,619,177 A * 4/1997 Johnson et al. ..... 337/140
5,909,078 A 6/1999 Wood et al.
6,044,646 A * 4/2000 Silverbrook ..... 60/528
6,070,851 A * 6/2000 Tsai et al. ..... 251/11
6,360,539 B1 * 3/2002 Hill et al. ..... 60/528

FOREIGN PATENT DOCUMENTS

WO WO 98 33195 A1 7/1998
WO WO 99 16096 A1 4/1999

OTHER PUBLICATIONS

Jae–Youl Lee and Sang–Won Kang: "A Characterization Of The Thermal Parameters Of Thermally Driven Polysilicon Microbridge Actuators Using Electrical Impedance Analysis"; Sensors And Actuators, vol. 75, No. 1, May 4, 1999, pp. 86–92, XP004170608; Elsevier Science S.A., Lausanne.

* cited by examiner

*Primary Examiner*—Hoang Nguyen
(74) *Attorney, Agent, or Firm*—Breiner & Breiner, L.L.C.

(57) ABSTRACT

The invention relates to a micro reactor arrangement, particularly for a micro relay. It comprises a substrate (1) with two thermomechanical micro actuators (3, 4). In response to thermal stimulation, the first micro actuator (3) performs a movement in parallel with the substrate surface (2), while the second micro actuator moves in a direction orthogonal on the substrate surface (2). Both thermomechanical micro actuators are so disposed relative to each other that the first micro actuator (3), in the extended state, reaches under the second micro actuator (4). With these provisions, the first micro actuator (3) can be maintained in this position without supply of power when the second micro actuator (4) is de-energized. With the present micro actuator arrangement, one can achieve the advantages of a high activation force and long positioning travels of thermomechanical micro actuators for micro relays, without the necessity to supply energy for maintaining the individual switching states.

11 Claims, 1 Drawing Sheet

MICROACTUATOR ARRANGEMENT

FIELD OF THE INVENTION

Figure 1:
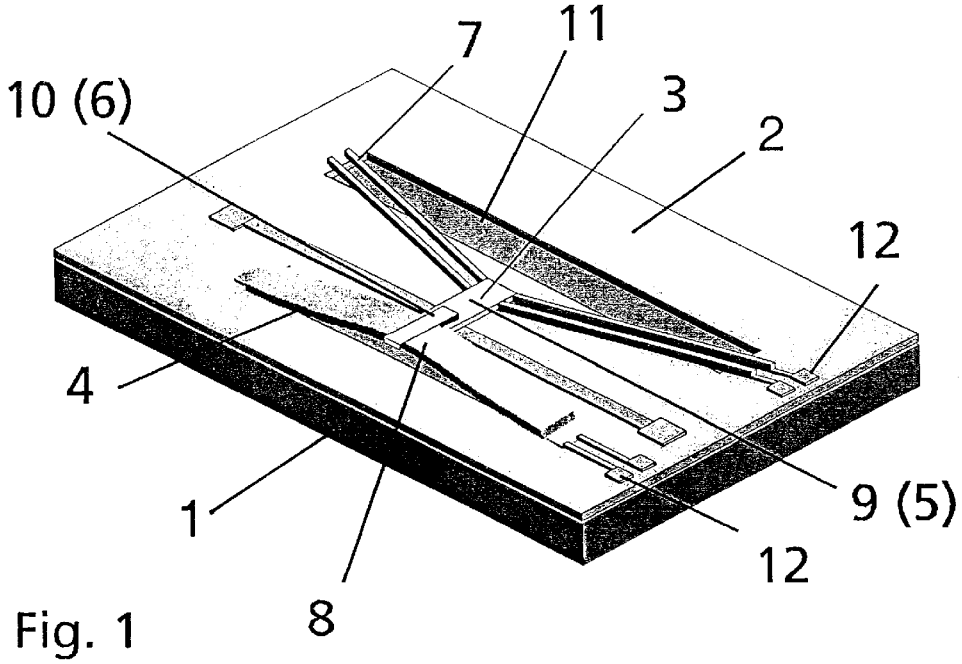

The present invention relates to a micro actuator arrangement including a substrate having a first thermomechanical micro actuator and a second thermomechanical micro actuator, wherein the first thermomechanical micro actuator is extended substantially in parallel with the surface of the substrate in response to a thermal stimulation. The micro actuator arrangement is particularly well suitable for the application as micro relay.

Micro relays are taking the place of conventional electromechanical relays to an ever-increasing extent because they can be manufactured as lower costs and at a reduced space required and as they achieve moreover shorter switching intervals due to their size. At present, these micro relays are normally realised on the basis of micro actuators operating on the principle of electrostatic effects. These electrostatic micro relays, however, excel themselves by comparatively short positioning travels and small activation forces of the micro actuators, which, on the one hand, results in problems in terms of the disruptive strength of the micro relay and, on the other hand, leads to problems caused by an increased contact wear.

By contrast, thermomechanical micro actuators, which are used in other fields of micro system technology, are characterised principally by the generation of comparatively high activation forces and long positioning travels with simultaneous moderate power consumption. They are used in micro system technology mainly for the design of micro actuator elements where a maximum possible of actuating forces and positioning travels is decisive. One example is the application in micro valves. As electrical power levels in the range of a few 100 mW are required, as a rule, for the operation of thermal micro actuators thermal drive systems have so far come into question mainly for the structure of individual actuator elements.

The fact that a thermomechanical micro actuator must continuously be heated by supplied energy in order to maintain its extended state (ON state), which is achieved by thermal stimulation, has, however, turned out to be a particular disadvantage. For this reason, thermomechanical micro actuators have so far not been used or used only in cases of exception in micro relays and in a great number of other applications.

PRIOR ART

The U.S. Pat. No. 5,909,078 discloses an example of a micro actuator arrangement including thermomechanical micro actuators in accordance with the introductory clause of patent claim 1. Here, an individual element or a plurality of bar-shaped elements in a side-by-side arrangement is/are used as micro actuators, which are clamped in parallel with a substrate surface on the substrate on both ends and which are biased in parallel with the substrate surface in a preferential direction. When the bar-shaped elements are heated they extend in the clamped condition so that a extension in the preferential direction results in parallel with the substrate surface. This extending movement may be used, for instance, for opening or closing a valve opening in the substrate.

The thermomechanical micro actuators of that prior art document can, however, not be used without occurrence of the aforedescribed disadvantages in a micro relay in which separate switching conditions must be retained over a major period of time.

The thermomechanical micro relay that is described by J.-Y. Lee et al. in "A characterization of thermal parameters of thermally driven polysilicon micro bridge actuators using electrical impedance analysis" in "Sensors and Actuators" A75 (1999, pp. 86–92, presents the same disadvantage. In that relay, a poly-silicon membrane having a bridge-like configuration is extended by heating in a direction orthogonal on the substrate surface in order to connect electrical contacts. However, a permanent energy supply is required to maintain this connection.

The prior art document WO 99/16096 discloses a micro relay composed of a plurality of thermomechanical actuators having the same structure and clamped, by means of bar-shaped elements, to the respective two ends on the substrate. The heating of the bar-shaped elements causes a extension of the two actuators in parallel with the substrate surface. Via mechanical locking mechanism, i.e. lateral hooking to the second actuator, it is possible to keep one of the actuators in a defined position in a de-energized state. The locking action can be eliminated again by operation of the second actuator.

Starting out from this prior art, the problem of the present invention consists in proposing a further micro actuator arrangement that permits a change-over between at least two switching states with a high activation force and a long positioning travel, with the possibility to maintain the respective switching conditions without power consumption.

BRIEF DESCRIPTION OF THE INVENTION

The problem is solved with the micro actuator arrangement according to patent claim 1. Expedient embodiments of the micro actuator arrangement are the subject matters of the dependent claims.

The present micro actuator arrangement consists of a substrate comprising at least two thermomechanical micro actuators. A first thermomechanical micro actuator is disposed on the substrate in a manner known from prior art, being extended substantially in parallel with the surface of the substrate in response to a thermal stimulation, i.e. performing its positioning movement substantially in parallel with the surface. In accordance with the invention, the second thermomechanical micro actuator is, on the one hand, so configured that it is extended, in response to thermal stimulation, substantially in a direction orthogonal on the surface of the substrate, which means that it performs its positioning movement substantially in a direction normal on the substrate surface. On the other hand, the second thermomechanical micro actuator is so arranged that, in response to thermal stimulation, one section of the first thermomechanical micro actuator—in the extended state—reaches under one section of the second thermomechanical micro actuator. As the second thermomechanical micro actuator performs a positioning movement substantially in a direction orthogonal on the substrate surface, hence one section of the first thermomechanical micro actuator in an extended state is located between one section of the second thermomechanical micro actuator and the substrate surface so that this section of the first thermomechanical micro actuator will be clamped by the second thermomechanical micro actuator when the latter is switched off.

This arrangement of two thermomechanical micro actuators makes it hence possible to maintain the switching state (ON state) of the first thermomechanical micro actuator without power consumption. When the state is changed over from the neutral condition (OFF state) into the ON state, initially both thermomechanical micro actuators are energized, i.e. thermally stimulated, so that a first section of the first thermomechanical micro actuator moves underneath a second section of the second thermomechanical micro actuator. Then the second thermomechanical micro actuator is de-energized, thus clamping the first section of the first thermomechanical micro actuator. When the latter is subsequently de-energized, equally by interruption of the heat supply, it remains in the extended position because it is held in this position due to the clamping effect produced by the de-energized second thermomechanical micro actuator. This holding position becomes possible, on the one hand, due to the friction between the two micro actuators and, on the other hand, by the high restoring force with which the second thermal micro actuator assumes its neutral position. In this manner, the extended state of the first thermomechanical micro actuator is maintained without any further supply of energy, i.e. in a de-energized condition. The release from this holding position merely requires a short energy supply to the second thermomechanical micro actuator, which releases the holding position and causes the first thermomechanical micro actuator to return into its neutral position (OFF state) in which it remains equally without the supply of energy.

On account of this property of the inventive micro actuator arrangement, that two switching conditions can be maintained without energy supply by means of thermomechanical micro actuators, the opportunity is opened up to use the high activation forces and long positioning travels of thermomechanical micro actuators also in those fields for which they have so far not been suitable. The present micro actuator arrangement is particularly well suitable for the application in micro relays but it can, of course, also be employed for other applications such as in micro valves. Specifically in the application in micro relays, the use of the present micro actuator arrangement permits the combination of comparatively long positioning travels with a comparatively high pressing force on the contacts to be bridged. The first thermomechanical actuator—which will also be referred to as lateral actuator in the following—can be so designed that it provides for travels or positioning distances of 50–80 $\mu$m. Due to these long positioning travels it is possible that the electrical contacts in relays present a major mutual spacing so that, on the one hand, the dielectric strength of the relays is increased whilst, on the other hand, crosstalk between individual lines is reduced. At the same time, the second thermomechanical actuator—which will also be referred to as z-actuator in the following—which holds the lateral actuator in a extended position, creates pressing forces in the range of 10 mN to 50 mN and more during its return movement. The lateral actuator hence ensures the long travel whilst the z-actuator provides the high pressing force for closing the relay contacts as it presses the lateral actuator with this pressing force against the substrate surface on which the contacts to be closed are disposed in the case of a micro relay.

The electrical power of 200–300 mW approximately for switching the micro relay is required only during the short switching phases whilst the individual switching states can be maintained without the supply of energy. The space required for the two micro actuators on the substrate corresponds, as a rule, to 2 mm×1 mm, approximately, and is hence comparable to the areas necessary for micro relays in correspondence with the principle of electrostatic action. In view of the achievable switching forces and the achievable switching travels, the present micro actuator arrangement is therefore distinctly superior to any micro relay concept to far known.

As a matter of fact, however, the inventive micro actuator arrangement is also suitable for other applications in which, on the one hand, at least two switching states must be maintained without the supply of energy and, on the other hand, high activation forces and long positioning travels are required.

Another advantage of the inventive micro actuator arrangement consists in the aspect that with this arrangement it is possible to realise not only two but also further switching states and to maintain them without the supply of energy. This requires merely that with different extensions caused by thermal stimulation in different intensities, the lateral actuator reaches under the z-actuator. This may be achieved, for example, by an arm of corresponding length on the lateral actuator, which extends along the direction of extension. In this manner, the lateral actuator can be held by the z-actuator in any extended position whatsoever. This configuration provides for a plurality of switching connections in a micro relay equipped with the inventive micro actuator arrangement.

Another preferred embodiment of the present micro actuator arrangement is distinguished by the provision that the two micro actuators get hooked with each other when they assume the holding position. This ensures a very reliable holding position in which the friction between the two actuators does not play a role. This hooking action can be realised with the provision that the two sections of the lateral actuator and of the z-actuator, which are superimposed in the holding position, are engaged with each other, for instance in the form that one of the two sections presents a recess into which a projection of the other one of the two sections engages. Other geometric configurations are also conceivable, of course, which result in a corresponding hooking or in a corresponding mutual engagement. Such configurations are well known to those skilled in the art in many fields of technology. In the case of several switching positions to be maintained, different holding positions can be defined by appropriate geometric configurations of the sections, in which the two sections are engaged with each other.

The manufacture and the different potential configurations of thermomechanical micro actuators are common to those skilled in the art. In the present micro actuator arrangement, too, a bar-shaped element is preferably used as basic element of the individual micro actuator, as is known, for instance, from the U.S. Pat. No. 5,909,078. This bar-shaped element is preferably etched out of the substrate in such a way that it remains clamped on both sides on the substrate. The second thermomechanical actuator, i.e. the z-actuator, equally consists of such an element that is connected to the substrate in the form of a bridge.

The thermal stimulation of the two elements may be carried out in the most different ways. Examples of thermal stimulation, such as radiation, arrangement of a heating element on the substrate, direct heating by current flowing through the actuator element or attachment of a thermal conduction layer on the actuator element are known to those skilled in the art. The possibility mentioned last is preferably employed in the present micro actuator arrangement by application of an appropriate thermal conduction layer, e.g. a poly silicon layer, on the bar-shaped elements.

The micro actuator arrangement is not restricted to a lateral actuator and a z-actuator. It is also possible to use several actuators of this kind in an appropriate arrangement on the substrate. It is likewise possible to provide a mechanical coupling of different lateral actuators, e.g. in the manner known from the U.S. patent identified in the introduction to this specification.

With the application as micro relay, the conducting paths or contact areas to be switched, i.e. to be electrically bridged, are applied on the substrate. For bridging the discontinuities between these contact areas, appropriate contact bridges of a well conducting material are provided on the underside of the lateral actuator. The actuator as such or the bar-shaped actuator elements, respectively, may consist of other materials. Preferably, however, nickel is used as material for the bar-shaped elements because it presents appropriate thermomechanical characteristics and is suitable for structuring the elements with the required dimensions, using the known means of micro structuring technology. In this case, the electrically conducting contact bridges as well as the thermal conduction layer are additionally insulated from the nickel via an intermediate layer.

Methods of manufacturing such thermomechanical micro actuators on a substrate can be derived from the technical literature at any time. As a rule, here a combination of photolithographic processes, methods of galvanic deposition and etching processes are involved.

Figure 2:
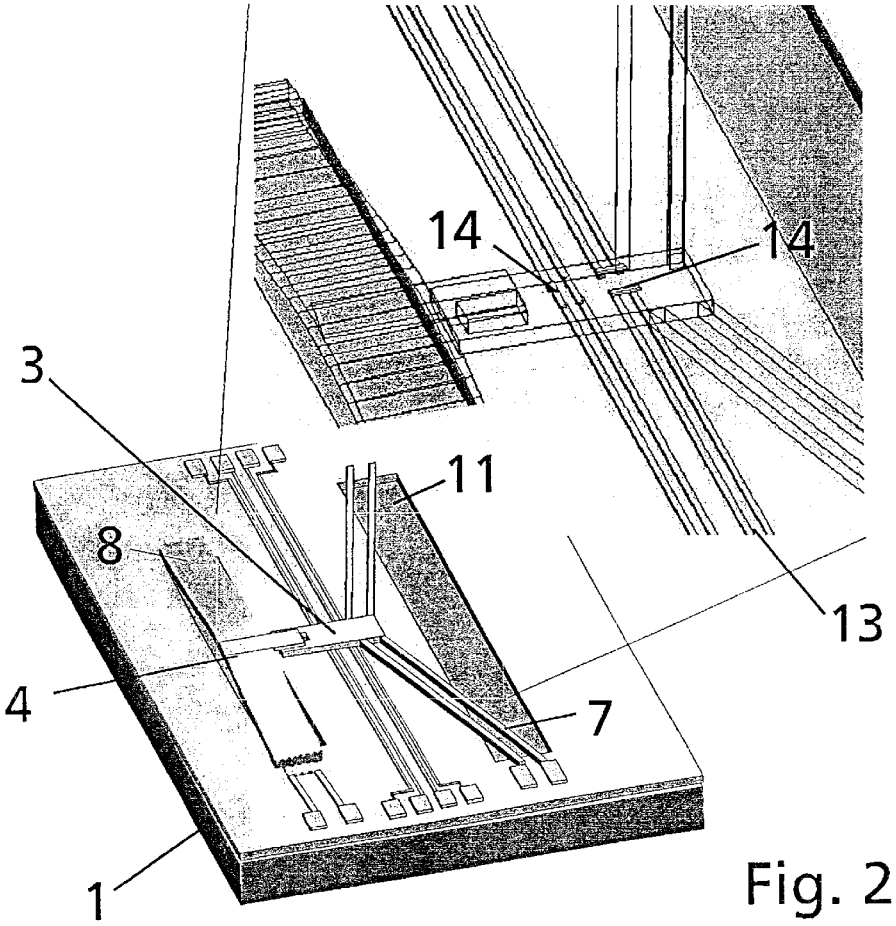

The present micro actuator arrangement will be described again in more details in the following by embodiments in combination with the drawings, without any restriction of the general inventive idea. In the drawing:

FIG. 1 is a schematic view of an example of an inventive micro actuator arrangement, and FIG. 2 illustrates another example of an inventive micro actuator arrangement applied as a micro relay.

WAYS OF REALIZING THE INVENTION

FIG. 1 shows a three-dimensional view of a micro actuator arrangement according to a first embodiment. The micro actuator arrangement consists of the substrate 1 that is a semiconductor substrate on which a lateral micro actuator 3 as well as a z-actuator 4 are disposed. The lateral actuator 3 is composed of four bar-shaped elements 7 that are each anchored on one side on the substrate 1. A plate-shaped arm 9 is attached on these bar-shaped elements, which extends along the direction of extension, which means in a direction towards the u-actuator 4. The lateral actuator 3 is clearly illustrated in the extended state in the Figure. In the neutral position, it is located above the roughly indicated recess 11 in the substrate surface that is produced during the manufacturing process when the bar-shaped elements 7 are created by etching under them. The bar-shaped elements 7 are provided with thermal conduction layers (not visible in the Figure) that are supplied with electric current via the corresponding connector pads 12. The bar-shaped elements here present dimensions in the typical range of roughly 1 mm in length, 5–10 $\mu$m in width and 15–20 $\mu$m in height.

The z-actuator 4 is equally composed of a bar-shaped element 8 that is clamped on both sides on the substrate 1. This z-actuator 4 is designed in the form of a bridge actuator. In this case, too, the bar-shaped element is provided with an appropriate thermal conduction layer that is not illustrated here and that is supplied with electric current via connector pads 12. A plate-shaped arm 10 is provided on the z-actuator 4, too, which extends along the direction of the lateral actuator 3. Both arms 9 and 10 may be engaged with each other by hooking action, which is created by an appropriate design, as is illustrated in the enlarged section in FIG. 2.

In the neutral position, the bar-shaped elements 7 of the lateral actuator are located above the recess 11 and the bar-shaped element 8 of the z-actuator 4 rests on the substrate 1. First of all, both actuators are operated for the transition into the ON state of the micro relay. As a result, the lateral actuator 3 shifts its plate-shaped arm 9 under the z-actuator 4. Then, the z-actuator is de-energized first and lowers onto the arm 9 with its arm 10. After de-energisation of the lateral actuator 3, a suitable hook-like structure prevents this contact from being released. For the transition into the OFF state, equally both actuators are initially energized. In this step, however, the lateral actuator 3 is de-energized before the z-actuator. Thus, the plate-shaped arm 9, which is designed in the form of a nickel platelet in this example, is retracted from below the z-actuator 4 so that the contacts are released. The FIG. 1 illustrates a micro actuator arrangement in the ON state. The bar-shaped elements 7, 8 as well as the arms 9, 10 of the two actuators 3, 4 are made of nickel in this example. The thermal conductor extending underneath the bar-shaped elements is separated from this metal structure by isolating layers.

FIG. 2 shows another example of a micro actuator arrangement according to the present invention for the application as a micro relay. In this Figure, too, the substrate 1 as well as the two micro actuators 3, 4 with the respective bar-shaped elements 7, 8 and the arms 9, 10 can be seen. Additionally, four conducting paths 13 are disposed on the substrate 1, of which all are discontinued by a gap—which can be recognized in the enlarged view. Contact bridges 14 for closing the open contacts are provided on the underside of the arm 9 of the lateral actuator 3. These contact bridges 14 may be made of a well conducting material such as gold, which is insulated from the material of the actuator. Hence, lower feed resistance values can be achieved in the relay. As is illustrated in the Figure, the present micro relay may serve to close several contacts or lines 13 even simultaneously. Even the realization of more than two switching states can be achieved with this relay structure. For example, a changeover from one of the lines to another line could be carried out without any problems.

The Figure shows the ON state of the micro relay, wherein the contacts of the four lines are closed in different ways, as can be seen in the enlarged view. The high pressing force of the contact bridges 14 onto the line 13 permits a long service life of the contacts. The high pressing force is generated by the return movement of the z-actuator 4 that presses on the lateral actuator 3. The enlarged view also shows a geometric arrangement of a possible hooking provision between the arm 10 of the z-actuator 4 and the arm 9 of the lateral actuator 3.

It is recommendable for the structure of the micro actuators to use a suitable metal such as nickel. In this manner it is possible to achieve not only the required strength levels but also a sound thermal conductivity of the bar-shaped elements so that the switching intervals of the relay range between 10 ms and 100 ms, approximately. Due to the very good electrical conductivity of the bar-shaped elements, however, the direct use as thermal conductor is precluded in this case. To this end, preferably a thermal conductor layer is applied on the actuator element proper, which must, of course, be isolated from the thermomechanical actuator proper.

List of Reference Numerals

1 substrate
2 surface of the substrate
3 lateral micro actuator
4 z-micro actuator
5 first section (9)

6 second section (10)
7 bar-shaped element
8 bar-shaped element
9 plate-shaped arm
10 plate-shaped arm
11 recess
12 connector pads
13 conductive paths
14 contact bridges

What is claimed is:

1. Micro actuator arrangement, comprising a substrate on which a first thermomechanical micro actuator and a second thermomechanical micro actuator are disposed, with said first thermomechanical micro actuator, in response to thermal stimulation, being extended in a direction substantially parallel with a surface of said substrate, wherein said second thermomechanical micro actuator is so configured and disposed relative to said first thermomechanical micro thermomechanical micro actuator is extended substantially in a direction orthogonal on the surface of said substrate and that, in an extended state, a first section of said first thermomechanical micro actuator reaches under a second section of said second thermomechanical micro actuator.

2. Micro actuator arrangement according to claim 1, wherein said first and/or said second thermomechanical micro actuator is/are composed of one or several bar-shaped elements that are clamped on both sides on said substrate.

3. Micro actuator arrangement according to claim 2, wherein said one or several bar-shaped elements are provided with a thermal conduction layer.

4. Micro actuator arrangement according to claim 2 or 3, wherein said one or several bar-shaped elements include an electrically conductive material.

5. Micro actuator arrangement according to claim 1, wherein said first section of said first thermomechanical micro actuator is designed as plate-shaped arm that extends along a direction of extension of said first thermomechanical micro actuator.

6. Micro actuator arrangement according to claim 5, wherein said plate-shaped arm has a length in the direction of extension of said first thermomechanical micro actuator such that in response to different extensions of said first thermomechanical micro actuator said plate-shaped arm reaches under said second section of said second thermomechanical micro actuator.

7. Micro actuator arrangement according to claim 1, wherein said second section of said second thermomechanical micro actuator is designed as plate-shaped arm that extends in a direction opposite to a direction of extension of said first thermomechanical micro actuator.

8. Micro actuator arrangement according to claim 1, wherein said first section and said second section are so designed that said first section and said second section engage in each other when the thermal stimulation of said second thermomechanical micro actuator is terminated while said first thermomechanical micro actuator is in the extended state.

9. Micro actuator arrangement according to claim 8, wherein said first section has a recess into which a projection on said second section engages or vice versa.

10. Micro actuator arrangement according to claim 1, further comprising one or several conducting paths and/or contact areas with one or more discontinuities on said substrate, which can be bridged by extension of said first thermomechanical micro actuator.

11. Micro actuator arrangement according to claim 10, wherein said first thermomechanical micro actuator presents one or several electrically conductive contact bridges for bridging said one or several discontinuities.

* * * * *

UNITED STATES PATENT AND TRADEMARK OFFICE

CERTIFICATE OF CORRECTION

PATENT NO. : 6,684,638 B2 
DATED : February 3, 2004
INVENTOR(S) : Hans Joachim Quenzer et al.

It is certified that error appears in the above-identified patent and that said Letters Patent is hereby corrected as shown below:

Column 7,
Line 11, “arrangment, comprising” should read -- arrangment comprising --.
Line 18, after “micro” insert -- actuator that upon thermal stimulation said second --.

Column 8,
Line 19, “engage in each” should read -- engage each --.

Signed and Sealed this

Thirteenth Day of April, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,684,638 B2
DATED : February 3, 2004
INVENTOR(S) : Hans Joachim Quenzer et al.

It is certified that error appears in the above-identified patent and that said Letters Patent is hereby corrected as shown below:

Title page,
Item [73], Assigneee, "Fraunhofer Gesellschaft zur angewandten Forderung der Forschung e.v." should read -- Fraunhofer-Gesellschaft zur Förderung der angewandten Forschung e.V. --.

Signed and Sealed this

Third Day of May, 2005

JON W. DUDAS
*Director of the United States Patent and Trademark Office*